US008162624B2

(12) United States Patent
Valbjoern et al.

(10) Patent No.: US 8,162,624 B2
(45) Date of Patent: Apr. 24, 2012

(54) REFRIGERANT COMPRESSOR

(75) Inventors: Jesper Valbjoern, Kolding (DK); Anders Jakob Madsen, Nordberg (DK); Kristoffer Riemann Hansen, Broager (DK)

(73) Assignee: Secop GmbH, Flensburg (DE)

( * ) Notice: Subject to any disclaimer, the term of this patent is extended or adjusted under 35 U.S.C. 154(b) by 213 days.

(21) Appl. No.: 12/260,132

(22) Filed: Oct. 29, 2008

(65) Prior Publication Data

US 2009/0116978 A1 May 7, 2009

(30) Foreign Application Priority Data

Nov. 3, 2007 (DE) ..... 10 2007 052 580

(51) Int. Cl.
*F04B 17/00* (2006.01)
*F04B 35/00* (2006.01)

(52) U.S. Cl. ..... 417/360; 417/363

(58) Field of Classification Search ..... 62/508; 417/312, 360, 363, 415, 902, 570; 248/200, 248/220.21, 226.11

See application file for complete search history.

(56) References Cited

U.S. PATENT DOCUMENTS

| | | | | |
|---|---|---|---|---|
| 2,239,723 | A * | 4/1941 | Limpert et al. | 417/419 |
| 2,583,583 | A * | 1/1952 | Mangan | 417/372 |
| 3,986,798 | A | 10/1976 | Lindell et al. | |
| 4,106,881 | A | 8/1978 | Stannow et al. | |
| 4,431,383 | A * | 2/1984 | Boehmler et al. | 417/312 |
| 4,566,865 | A * | 1/1986 | Nishitsuji et al. | 417/363 |
| 2004/0057850 | A1 | 3/2004 | Nozaki et al. | |
| 2005/0089412 | A1 * | 4/2005 | Kwang-Tsan | 417/363 |

FOREIGN PATENT DOCUMENTS

| | | |
|---|---|---|
| DE | 2617388 | 8/1978 |
| WO | 2004/059168 A | 7/2004 |

* cited by examiner

*Primary Examiner* — Devon C Kramer
*Assistant Examiner* — Bryan Lettman
(74) *Attorney, Agent, or Firm* — McCormick, Paulding & Huber LLP

(57) ABSTRACT

A refrigerant compressor (1) includes a cylinder block (4), in which a cylinder (14) is arranged, and a cylinder head (16), which covers the front side of the cylinder (14) and is connected to the cylinder block (4) by a plurality of threaded bolts (18, 19). It is endeavored to achieve a good performance with a small mass of the refrigerant compressor. For this purpose, it is ensured that at least two threaded bolts (18) extend through the cylinder block (4) and are screwed into a common mating thread element (23) at the end projecting from the cylinder block (4).

8 Claims, 1 Drawing Sheet

REFRIGERANT COMPRESSOR

CROSS REFERENCE TO RELATED APPLICATION

Applicant hereby claims foreign priority benefits under U.S.C. §119 from German Patent Application No. 10 2007 052 580.1 filed on Nov. 3, 2007, the contents of which are incorporated by reference herein.

FIELD OF THE INVENTION

The invention concerns a refrigerant compressor with a cylinder block, in which a cylinder is arranged, and a cylinder head, which covers the front side of the cylinder and is connected to the cylinder block by means of threaded bolts.

BACKGROUND OF THE INVENTION

Such a refrigerant compressor is, for example, known from DE 26 17 388 C3. In the cylinder is arranged a piston, which is reciprocated through a motor by means of a connecting rod drive. The cylinder block extends into a bearing unit for the crank shaft. The cylinder block comprises four threaded bores, the threaded bolts fixing the cylinder head to the cylinder block being screwed into said bores.

The machining of the cylinder block during manufacturing must ensure that the piston fits with the cylinder with relatively narrow tolerances. Accordingly, an accurate manufacturing of the cylinder bore is required. Also with a very accurate manufacturing of the cylinder, however, the manufacturing of the threaded bores in the cylinder block may again cause deformations of the cylinder, which may harm the tightness of the bearing of the piston in the cylinder and thus the efficiency of the compressor. In order to remedy this problem, the cylinder block must have a relatively massive design, which makes the manufacturing of the compressor expensive, and at the same time the compressor has a large mass, which makes it heavy during transportation.

SUMMARY OF THE INVENTION

The invention is based on the task of providing a refrigerant compressor, which achieves a good efficiency with a smaller mass.

With a refrigerant compressor as mentioned in the introduction, this task is solved in that at least two threaded bolts extend through the cylinder block and are screwed into a common mating thread element at the end projecting from the cylinder block.

With this embodiment, at least two of the cylinder bolts will no longer require threaded bores in the cylinder block. On the contrary, through openings will be sufficient, which will, in many cases, not even require machining. Therefore, these openings can, for example, be made during moulding. As the threaded bolts extend through the cylinder block, they must have a relatively large length. The larger length of the threaded bolts causes an improved elasticity. Accordingly, a smaller tightening torque is required to fix the cylinder head reliably and tightly to the cylinder block. This again reduces the risk that the cylinder block is deformed and forms a leakage in relation to the piston. The mating thread element, which is common for several threaded bolts, simplifies the assembly. The threaded bolts no longer require individual threaded nuts to be retained at the rear of the cylinder block until the threaded bolt has caught the thread during fixing. On the contrary, the mating thread element is already secured against rotation, when two threaded bolts have been inserted. This simplifies the assembly.

Preferably, the mating thread element has a recess, which interacts with a counterpiece that is arranged at a housing, in which the cylinder block is located. The mating thread element then serves a second purpose. Usually, the cylinder block is movably supported in the housing on springs or the like, to avoid an oscillation transfer from the cylinder block to the housing and thus also to the outside. However, this support made it possible for the cylinder block or parts connected to it to hit against the housing during assembly of the refrigerant compressor in a refrigeration appliance or during transport of the refrigerant compressor or the refrigeration appliance. The mating thread element now offers an opportunity of preventing an excessively large movement of the cylinder block in relation to the housing. A movement of the cylinder block in the housing is only possible to the extent permitted by the mating thread element and the counterpiece. As soon as the mating thread element reaches the counterpiece, further movements are prevented.

Preferably, the recess is formed as a through opening. The counterpiece then projects through the through opening. Further, this embodiment has the advantage that during assembly the mating thread element can easily be retained at the recess, for example by means of a tightening pin.

Preferably, the recess is arranged at an angled area of the mating thread element. Thus, it is no longer necessary that the counterpiece interacting with the recess of the mating thread element extends in the same direction as the threaded bolt. The selection of the direction and the position of the counterpiece is more flexible.

Preferably, the mating thread element has a body and at least one threaded area with a larger thickness than the body. Basically, the only task of the body is to connect the threaded areas and, under certain circumstances, with the recess to form a movement direction for the cylinder block. Accordingly, it can be designed relatively weak. In order still to achieve a sufficient length for the inner thread, into which the threaded bolts are screwed, the area, in which the inner thread is arranged, the so-called threaded area, has a larger thickness. The larger thickness can be designed in different ways. Additional material can be added. The threaded area can be formed by a folding of the material of the body. The thickening can be formed by an upsetting. Regardless of the manufacturing method, this causes a sufficient engagement length of the threaded bolt in the mating thread element.

Preferably, two threaded areas are arranged in connectors, a free space being provided between the connectors. In this free space other elements of the compressor can then be arranged, for example a wall surrounding the cylinder, the wall being at the same time part of the cylinder block.

Preferably, a piston driven by a motor is arranged in the cylinder, and the mating thread element interacts with threaded bolts, which are located at the side of the cylinder facing away from the motor. In order to simplify the following explanation, the threaded bolts located at the side of the cylinder facing away from the motor are called "upper threaded bolts", and the other threaded bolts are called "lower threaded bolts". In the position, in which the lower threaded bolts are located, the cylinder block usually has sufficient material. Accordingly, here sufficient space is available for manufacturing the threaded bores for the lower threaded bolts, without risking a deformation of the cylinder. With the upper threaded bolts, it is different. Here, however, it will now be sufficient to provide a flange, through which the threaded bolts are guided.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figures 1, 2:
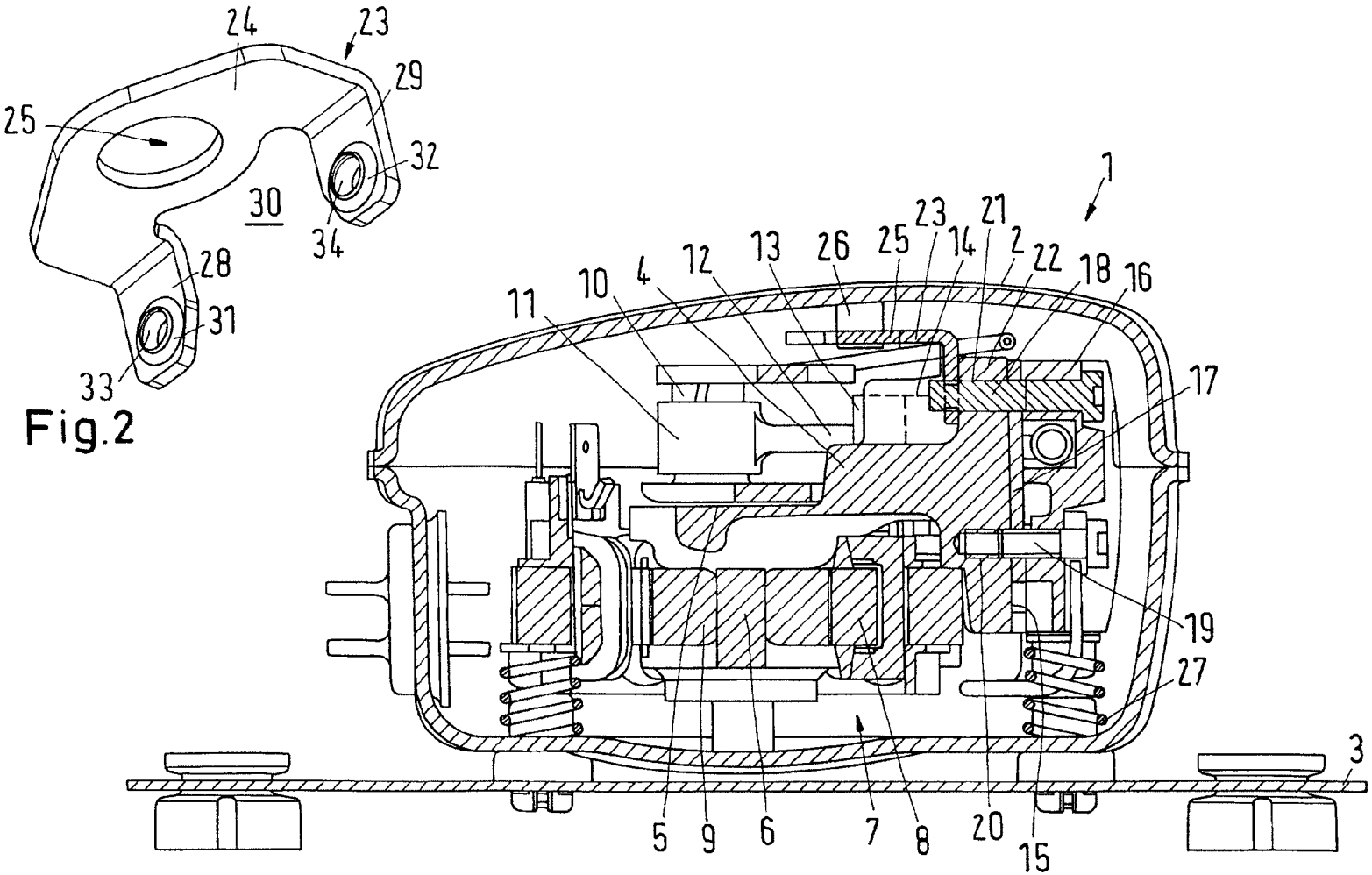
FIG. 1 is a schematic view of a longitudinal section through a refrigerant compressor.
FIG. 2 is a perspective view of a mating thread element.

A refrigerant compressor 1 has a hermetically enclosed housing 2, by means of which it can be built into a refrigeration appliance 3.

A cylinder block 4 is arranged in the housing 2. The cylinder block 4 forms a bearing 5 for a shaft 6 of a motor 7, whose stator 8 is connected to the cylinder block 4. A rotor 9 of the motor 7 is unrotatably connected to the shaft 6. At its upper end, the shaft 6 has a crank pin 10, on which a crank eye 11 of a connecting rod 12 is supported. The other end of the connecting rod 12 is connected to a piston 13 and converts the rotary movement of the shaft into a reciprocating movement of the piston 13.

The piston 13 is arranged in a cylinder 14, which is formed in the cylinder block 4. Here, the cylinder 14 is drawn with dotted lines.

The cylinder block 4 has a front side 15, at which a cylinder head 16 is arranged, which covers the cylinder 14. A cylinder head sealing 17 is arranged between the cylinder head 16 and the cylinder block 4. A valve plate with suction and pressure valves as well as a suction and pressure muffler, as known per se and not shown in detail, is arranged in the cylinder head 16.

Via upper threaded bolts 18 and lower threaded bolts 19 the cylinder head 16 is connected to the cylinder block 4. The term "upper threaded bolts" 18 covers the threaded bolts arranged at the side of the cylinder 14 facing away from the motor 7. The "lower threaded bolts" 19 are the threaded bolts arranged at the side of the cylinder 14 facing the motor 7.

The lower threaded bolts 19 are screwed into threaded bores 20, which are formed in the cylinder block 4. These threaded bores 20 have a relatively large distance to the cylinder 14. Therefore, when making the threaded bores 20, there is practically no risk that the cylinder 14 is deformed in the cylinder block 4. Laterally to the drawing level, two threaded bores 20 and two lower threaded bolts 19 are arranged after each other, namely on both sides of an axis extending through the cylinder 14 in parallel to the drawing level.

The upper threaded bolts 18 are guided through openings 21, which are formed in a flange 22 of the cylinder block 4 projecting from the cylinder 14. These through openings 21 can already be made during the manufacturing of the cylinder, for example during moulding. A machining of the through bores 21 is possible, however, in many cases not needed.

In order to ensure that the upper threaded bolts 18 (also here, two upper threaded bolts 18 are arranged after each other laterally to the drawing level) can be used for fixing the cylinder head 16 to the cylinder block 4, the two upper threaded bolts 18 are screwed into a mating thread element 23. In FIG. 2, the mating thread element 23 is shown in an enlarged view.

The mating thread element 23 has a body 24, which can be made of sheet metal. The body 24 has a through opening 25, by means of which it is guided across a counterpiece 26 that is fixed at the inside of the housing 2. A movement of the cylinder block 4 in relation to the housing 2 therefore only possible until the edge of the through opening 25 of the mating thread element 23 hits the counterpiece 26. Otherwise, a movement of the cylinder block 4 in relation to the housing 2 is made possible by means of springs 27, with which the cylinder block 4 is supported in the housing 2.

Two connectors 28, 29 extend from the body in an angle. A free space 30 is formed between the two connectors 28, 29. In the free space 30 the area of the cylinder block 4 is located, in which the cylinder 14 is formed.

Each connector 28, 29 has a threaded area 31, 32, which have a larger thickness than the body 24. For example, the threaded area 31, 32 is 1.5 to 2.5 times thicker than the body 24. Each threaded area 31, 32 comprises an inner thread 33, 34, into which a threaded bolt 18 is screwed. The fact that the threaded area 31, 32 has an increased thickness ensures that a sufficient engagement length with the threaded bolt 18 is available.

The upper threaded bolts 18 are, as can be seen from FIG. 1, longer than the lower threaded bolts 19. Thus, the upper threaded bolts 18 have a larger flexibility than the lower threaded bolts 19, and a smaller tightening torque is required to fix the cylinder head 16 to the cylinder block 4. Accordingly, the risk of deforming the cylinder 14 during fixing of the cylinder head 16 is reduced.

As the risk of deforming the cylinder 14 is smaller, the amount of material required for the cylinder block 4 is reduced. Without loosing tightness and thus without reducing the efficiency, a cylinder block 4 with a relatively small mass can be formed.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A refrigerant compressor comprising:

a housing with a counterpiece extending therefrom;

a cylinder block is movably supported within the housing;

a cylinder is arranged in the cylinder block; and a cylinder head, which covers a front side of the cylinder and is connected to the cylinder block by means of a plurality of threaded bolts, wherein at least two of the plurality of threaded bolts extend through the cylinder block and are screwed into a common mating thread element at an end projecting from the cylinder block, the mating thread element has a recess to accept the counterpiece therein to allow movement of the cylinder block with respect to the housing.

2. The refrigerant compressor according to claim 1, wherein the recess is formed as a through opening.

3. The refrigerant compressor according to claim 1, wherein the recess is arranged at an angled area of the mating thread element.

4. The refrigerant compressor according to claim 1, wherein the mating thread element has a body and at least one threaded area with a larger thickness than the body.

5. The refrigerant compressor according to claim 1, wherein the mating thread element has two threaded areas arranged in connectors, a free space being provided between the connectors.

6. The refrigerant compressor according to claim 1, wherein a piston driven by a motor is arranged in the cylinder, and the mating thread element interacts with the plurality of threaded bolts, which are located at a side of the cylinder facing away from the motor.

7. The refrigerant compressor according to claim 1, wherein the recess is oversized to reduce transmission of vibrations from the cylinder block to the housing.

8. The refrigerant compressor according to claim 1, wherein the cylinder block is supported within the housing by at least one spring.

* * * * *